United States Patent [19]

Makowka

[11] Patent Number: 4,834,552

[45] Date of Patent: May 30, 1989

[54] TAMPER-EVIDENT SEAL FOR ENVELOPE AND METHOD OF MAKING SAME

[76] Inventor: Kenneth R. Makowka, 19 Stirrup Pl., Wilton, Conn. 06897

[21] Appl. No.: 172,210

[22] Filed: Mar. 23, 1988

[51] Int. Cl.[4] ..... B65D 33/14

[52] U.S. Cl. ..... 383;5; 383/84; 229/102; 206/807

[58] Field of Search ..... 383/5, 84; 229/102; 206/807

[56] References Cited

U.S. PATENT DOCUMENTS

| | | | |
|---|---|---|---|
| 1,013,571 | 1/1912 | Stevens | 229/69 |
| 3,368,741 | 2/1968 | Mercur | 229/70 |
| 3,537,638 | 11/1970 | Hyman | 229/70 |
| 4,082,880 | 4/1978 | Zboril | 428/220 |
| 4,483,018 | 11/1984 | Whelan | 383/5 |
| 4,510,621 | 4/1985 | Saki et al. | 206/807 |
| 4,709,397 | 11/1987 | Uoshall et al. | 383/5 |
| 4,712,729 | 12/1987 | Craig | 229/72 |
| 4,720,040 | 1/1988 | Gurewitz | 383/5 |
| 4,733,817 | 3/1988 | Makowka | 229/69 |

FOREIGN PATENT DOCUMENTS

| | | | |
|---|---|---|---|
| 2295885 | 7/1976 | France | 383/84 |
| 1380727 | 1/1975 | United Kingdom | 383/84 |
| 183489 | 11/1985 | United Kingdom . | |

OTHER PUBLICATIONS

"The Keepsake System" Brochure (undated) of Mordon Wrappings, Ltd., UK.

"Safe-Gard Security Envelope" Brochure (undated) of Trigon Packaging Systems (N2) Ltd.; New Zealand.

*Primary Examiner*—Willis Little

[57] ABSTRACT

A tamper-evident seal for a plastic envelope with a pocket and closing flap having an adhesive sealing means and a tamper-evident layer(s) between the sealing means and plastic pocket for visually determining when tampering has occurred, said means becoming disrupted and visually distorted when a tamper attempt has been made on the flap of the envelope and another tamper-evident layer(s) on the region of the plastic material where the seal is to be made.

31 Claims, 2 Drawing Sheets

TAMPER-EVIDENT SEAL FOR ENVELOPE AND METHOD OF MAKING SAME

BACKGROUND OF THE INVENTION

This invention relates to an envelope and method of making an envelope and, more particularly, to envelopes having a tamper-evident feature to indicate when tampering has occurred after the envelope has been closed and sealed.

There is a continuous need for containers for the shipment and handling of items, especially valuable items. In addition to the use of such containers for money, such as the deposit of daily money receipts in a bank's night depository by retail establishments, other items of value must be transferred between parties. These include checks, bonds, stocks, food stamps, coupons, medical reports and samples, jewelry, confidential documents, etc. Because of the underlying value of such items, the containers used for such transport and storage should be of high integrity. The container, in addition to being capable of being handled during transfer without being broken or opened unintentionally to provide access to the contents, must be capable of indicating when its integrity has been compromised.

Containers of this type are known in the prior art. For instance, U.S. Pat. No. 4,483,018 discloses a container alleged to be disposable, of high integrity and tamper resistant. The container is formed of thermoplastic with an opening to insert contents. A flap with adhesive is closed over the opening and bonded to the container material. The flap has a detachable end, and both the flap and the detachable end have identical identification indicia thereon. The container also has tamper attempt indicating perforations running through the adhesive and indicia parallel to the envelope opening.

Another such security container is disclosed in European Patent Application No. 85308475.4, published June 4, 1986. Here a single container used as a security bag has a flap and lip which unite through activation of the adhesive. By the use of this structure, the bag cannot be opened without severing the material of the bag, thus making the bag tamper evident. Once an attempt to open the bag is made, it is difficult to realign the row of slits and pilferage becomes apparent.

A problem has recently been uncovered regarding the use of adhesive type materials to seal plastic envelopes. It has been found that once the seal has been activated to secure the contents in the envelope, the seal can be reopened, some or all the contents removed and the flap resealed, all without any indication that tampering with the envelope flap has occurred. This can be carried out by the application of low temperatures to the adhesive region. For instance, a spray from a can of freon-like material or the application of dry ice to the adhesive region will cause the adhesive to separate from the plastic envelope so that the flap can be lifted off the envelope and access gained to the contents. After the removal of the low temperature, the adhesive will readily reseal the flap to the plastic envelope without any evidence of tampering.

The present invention is a new and improved approach to providing a tamper-evident seal for an envelope and method of making such an envelope.

SUMMARY OF THE INVENTION

The present invention relates to a tamper-evident attachment means such as those used with security envelopes or containers, and method of making the same.

In one embodiment of the present invention an envelope closing means has an adhesive sealing means with a tamper-evident means and the region of the envelope adjacent where the sealing means is secured to the envelope material also has tamper-evident means. Any attempt to reopen the closing means after it has been sealed will disrupt the continuity of one or both of the tamper-evident means so as to make it evident that tampering has occurred. The tamper-evident means includes at least one layer of tamper-evident material. In a second embodiment of the invention the tamper-evident means includes a paper-like layer(s) between the sealing means and the envelope and a second paper-like layer(s) on the region of the envelope where the sealing means is sealed to the envelope material. In a third embodiment the sealing means and tamper-evident layer(s) are located on the envelope and the second tamper-evident layer(s) is located in the region of the closing means where the sealing means is to be sealed to the closing means. In a forth embodiment both the envelope and the closing means have an adhesive sealing means and a tamper-evident layer(s).

A method of making a tamper-evident envelope is also contained herein. The method includes adhering a tamper-evident layer at least partially to the region of the plastic envelope where the seal is to be located, adhering an adhesive seal material to the same region of the envelope at least partially over the tamper-evident layer and adhering a second tamper-evident layer(s) at least partially to the region of the envelope to which the sealing means is to be located upon the sealing of the envelope.

DETAILED DESCRIPTION OF THE PREFERRED EMBODIMENTS

Although the invention is described herein in a particular environment, that of the shipment of items, particularly valuable items in a secure manner, such as in a security envelope, it is to be understood that the invention is not so limited. It can be used to contain, ship, bundle, store, etc. any type of item wherein a tamper-evident means is desirable. It can also be used to provide a tamper-evident attachment means for plastic material which is utilized in a more general environment.

As shown in the Figures, the container, here an envelope having a single pocket, is a relatively flat container which can be constructed of any suitable material such as paper, plastic, etc. The envelope material in this embodiment is in sheet form and folded upon itself to form a pocket with a base 12 and two side seams 14, 16. The side seams may be formed in any suitable manner such as by heat welds formed by impulse welding or by the application of glue such as a thermoplastic glue. The seams should be of adequate strength to prevent them from being compromised or easily opened. If desirable, double or multiple panels of such material can be used to make the envelope.

Figure 2:
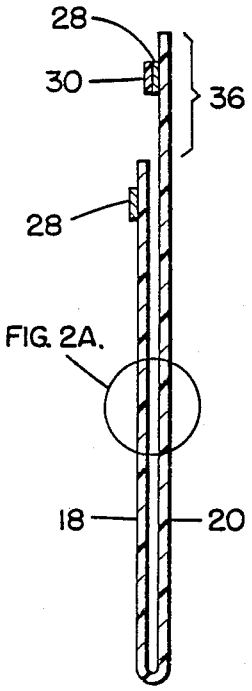
FIG. 2 is a schematic illustration of the same envelope as shown in FIG. 1 along cross-section 2—2 showing the tamper-evident layers between the flap and the adhesive strip and on the back panel of the envelope where the seal takes place when the envelope is sealed.
Figure 3A:
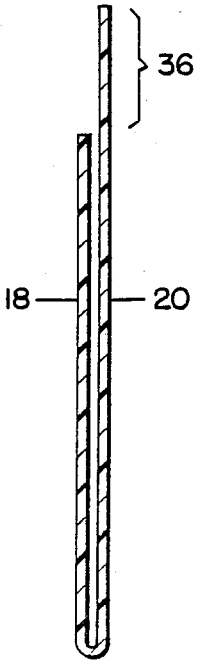
FIGS. 3*a–d* are schematic illustrations along cross-section 2—2 of FIG. 1 of the process steps for applying the tamper-evident layer to an envelope, and then sealing the flap over the opening of the envelope.
Figure 3B:
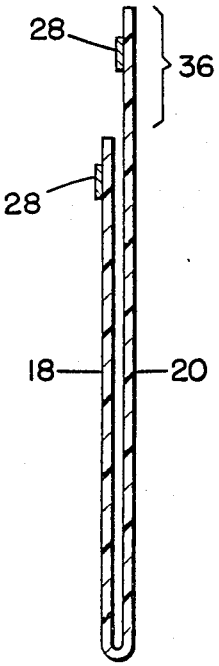
Figure 3C:
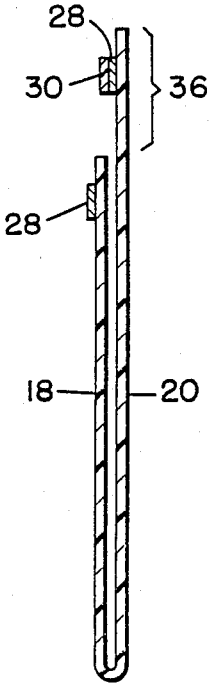
Figure 3D:
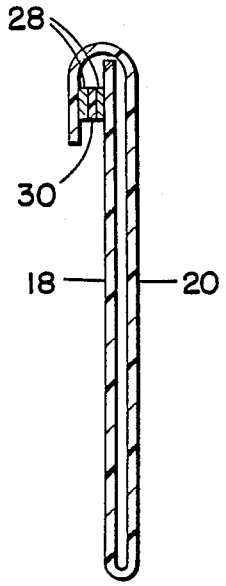

The folded material makes envelope 10 having a front panel 20 and a back panel 18 with access opening 22 at the edge 24 of the back panel. The front panel has edge 26 which, in this embodiment, is substantially above edge 24 to form a closing means or flap 36. The access opening 22 provides an opening to the interior of the envelope pocket for the placement of items into the pocket. The front panel has a securing means or in this embodiment, adhesive strip 30 while the back panel has a tamper-evident means 28. By folding flap 36 over opening 22 and sealing adhesive strip 30 onto the tamper-evident means 28, a completely sealed envelope is provided. The adhesive can be of the pressure-activated type and can have a peelable cover on its outer surface which is removed before it is joined to the tamper-evident means. The adhesive strip can be of the type disclosed in U.S. Pat. No. 4,483,018, for example, this patent being incorporated by reference herein. Adhesive strip 30 has a tamper-evident layer 28, as seen in FIG. 2, between it and the front panel of the envelope.

A tamper-evident envelope system can be made having multiple pockets and the pockets can be optionally detachable or non-detachable from one another, as described in my copending patent application, Ser. No. 011,911, filed on Feb. 5, 1987, which is incorporated by reference herein. The pockets can be any suitable size and shape for holding the items to be contained therein. The pockets may be of varying sizes, such as a relatively small pocket and a relatively large pocket, or, in the alternative, the pockets may be the same size. The envelope system may be made of a single panel of material or of multiple panels whether there is a single pocket or multiple pockets.

The envelope system 10 is shown as being made of a single panel or sheet. The panel is folded at base 12 to form the front 20 and back 18 panels of the envelope system. In this embodiment fold 12 forms the bottom portion of the pocket and the side portions are formed by bonding the front and back portions together in regions 14 and 16. Bonding can be accomplished by any suitable process such as the application of pressure and heat to the envelope material where bonding is intended as is well known in the art.

The envelope may be made of any suitable material. If used for security shipments, the panel should be made of a high integrity, strong, flexible material which is resistant to tearing and puncturing and which can take high impact stresses and twisting and otherwise relatively rough handling without ill effects. Examples of suitable materials for the envelope shown in the Figures are plastic materials such as polyethylene, polypropylene, polyolefin, etc. As an example, the envelope can be made of conventional monolayer films or, alternatively, multiple layer coextruded or laminated films or construction such as polyethylene, polypropylene, polyolefin, etc. In some applications the immediately above materials may be combined with nylon, surlyn, foils, polyesters, etc. depending upon the application requirements and cost considerations. The materials disclosed in U.S. Pat. No. 4,082,880 can also be used. The thickness of the envelope material can be any suitable dimension to provide the characteristics of the envelope as desired. For example, when using polyethylene or polypropylene, it has been found that a thickness of about 0.0002 inches (2 mils) and heavier works well for a security envelope.

The envelope material may be in the form of a single layer or multiple layer laminate or extrusion. The material may be opaque, translucent, transparent or any mixture thereof. It can be in any desired color. The envelope is desirably water-resistant and preferrably watertight and airtight. However, in some applications, especially in large size envelopes, small holes may be strategically placed in the pockets to enable air trapped inside the pocket after it is closed to escape may be desirable. The material may also be printed upon to affix indicia, identify the sender and/or receiver and provide intended use and instructions thereon.

Figure 1:
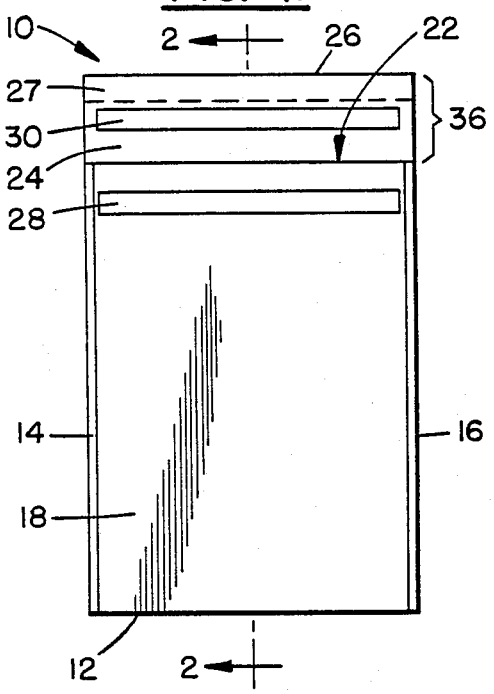
FIG. 1 is a schematic illustration of the back side of an envelope before the closing means is closed over the access opening and secured to the pocket material.
Figure 1A:
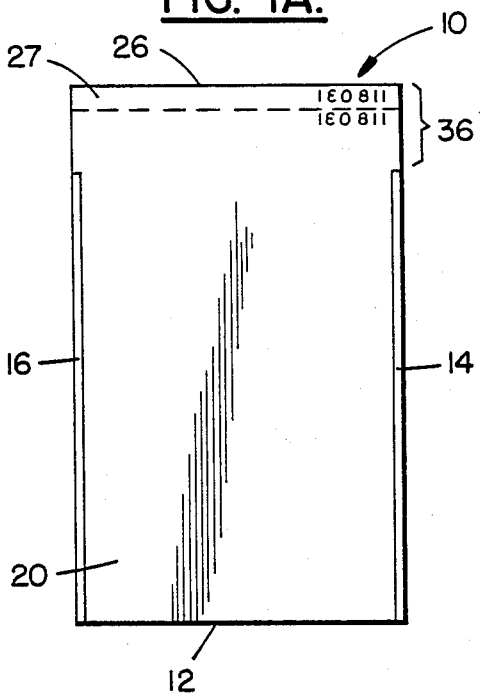

As described in the aforementioned Ser. No. 011,911, each envelope, whether it be a single pocket envelope or a multiple pocket envelope, may have identical or somewhat similar indicia on the envelope and a detachable end portion, such as end portion 27 in FIG. 1, on the end of the flap so that when the end portion of the flap is detached from the flap's main portion, a receipt bearing identical or similar indicia as on the pocket is provided. The indicia can be printed on the main portion of the flap or placed on some other part of the envelope such as in the center region of the envelope. The indicia can be alphanumeric or any suitable indicia such as graphic, bar code, colors, holographic, and so forth.

There should be means to secure the opening of each envelope after the contents are inserted. As described above this can be done by an adhesive material 30 residing on the main portion of flap 36. Any suitable securing system can be used such as an adhesive strip that has a peel back top strip which is removed prior to activating the adhesive. In the envelope shown in the Figures the contents are placed in the envelope, the peel back strips removed from the adhesive strips 30, the flap folded over the opening to close the opening and at least partially overlap with tamper-evident means 28 and pressure applied to the adhesive strip to seal the flap onto the pocket.

Many alternatives and enhancements can be made to the invention as disclosed above. The pockets can be made disposable after a single use or can be reused several times. In multiple pocket envelope systems, the number of pockets in an envelope system can be matched to the number of item types to be handled by a system; e.g., 8, 12, 16 or more individual pockets can be made into an envelope system. The envelope material can be made in a relatively flat configuration as viewed from the side or can be made to receive thicker materials by such means as providing expandable folds in the front and back portions of the pockets. The front and/or back portions of the envelope may have address windows and areas which are particularly adapted to receive stamps and typewritten or handwritten addresses and instructions. In addition, an envelope may have an additional envelope attached to it for mailing purposes.

It is also possible to construct the pockets or envelopes without the flap attached. In this case the flap could be a separate item which would be applied over the opening of a envelope with means to secure the opening, such two strips of adhesive with a fold in between so that the strips can be sealed to the front and back portions of the pocket to make it completely sealed around its periphery to close the opening. In this case the flaps could be preprinted with indicia to match that of the pocket or envelope, or a particular envelope system, or could have a region thereon for the user to write in the indicia of the pocket or envelope.

As described in U.S. Pat. No. 4,483,018, high integrity, tamper-evident containers or envelopes made of plastic with pressure sensitive closing means applied on opposite mateable surfaces have been disclosed in the past. In this type of envelope it has been found that with the application of low temperatures to the adhesive strip area after the envelope has been sealed, the adhesive will unseal itself from the plastic. The flap can then be opened, the contents or at least some of the contents removed and the flap resealed after the low temperature has dissipated from the adhesive region. This can be carried out in such a manner that there is no evidence, visual or otherwise, that unauthorized entry of the envelope has occurred. Furthermore, this opening procedure can be carried out quickly with the application of dry ice or the spray of "Component Cooler" catalog number 64-2321 sold by Radio Shack under the brand name "Realistic", for example.

As described in the aforementioned patent, perforation lines can be placed on the flap within the adhesive region and indicia disposed across the perforations. It is hoped with this system that any material distortion of the flap, such as during tampering, will disrupt the specific relationship of the indicia and visibly show the tampering attempt. This is not believed to be a reliable method of detecting tampering attempts, especially in the instance where low temperature is applied to the adhesive region, because most of the materials used in the manufacture of disposable plastic envelopes are primarily polyolefins and are non-porous. Consequently, the adhesive does not penetrate into the plastic material, due to close molecular structure, but rather only adheres to the outer surface of the plastic. Upon application of low or high temperatures, the adhesion dissipates and the flap can be opened and then resealed at more normal use temperatures. The improvement herein is the employment of a tamper-evident layer(s) between the plastic material and adhesive strip. Referring to the Figures, particularly FIG. 2, tamper-evident layers 28 are shown in this embodiment. If after the envelope is sealed by the adhesive strip, attempts are made to reopen the envelope flap by the application of low temperature to the adhesive area and then reseal the flap, the tamper-evident layer(s) will visually indicate that tampering has occurred even after the flap is resealed.

The tamper-evident layers(s) 28 can be made of any suitable material that evidences tampering. For instance, paper is used in one embodiment. The term "paper" is used herein in its broadest sense, such as including a flexible material made of pulp of rag, straw, wood or other firous material or any combination thereof. In the case of the embodiment shown in the Figures, the paper is preferrably a relatively thin, flexible material.

As shown in FIGS. *3a–3d,* to apply the tamper-evident layer(s), such as paper, to a plastic envelope or container 10, an envelope can first be fabricated to the point just short of applying the adhesive strip to the flap. This condition is shown in FIG. *3a.* Next a relatively thin paper strip 28 is made to adhere to the flap in the region where the adhesive strip is to be applied. A second such paper strip is made to adhere to the back of the envelope in the area thereof where the adhesive strip will be sealed onto the envelope after closing the flap.

Adhesion of the paper to the plastic of the envelope can be done in any suitable fashion. For instance, the side of the paper strip that is to interface with the plastic envelope can be coated with a heat-activatable layer such as polyethylene. When it is to be applied to the envelope, the heat-activatable layer is heated, which can be done at relatively low temperatures such as in the range of 140 to 160 degrees, to activate the heat-activatable layer. A paper strip is then placed on the flap and on the back panel of the envelope as shown in FIG. *3b* where it adheres to the flap via bonding or lamination. Example thicknesses for the paper used for this purpose include from about 10 pounds per 1000 inches (MSI) to about 70 MSI, but preferrably from about 15 MSI to about 40 MSI. Example thicknesses for heat-activatable material that adheres the paper strip to the envelope is from about 0.00025 inches to about 0.02 inches, but preferrably from about 0.0005 inches to about 0.002 inches. Other heat-activatable materials that can be used on the paper strip are lamination adhesives, polypropylene, high density, linear low density and low density plastics, polystyrene, oriented polystyrene or any type of heat-activatable material suitable to the material of the envelope. Next the adhesive sealing strip, such as the strip disclosed in U.S. Pat. No. 4,483,018, is placed at least partially on top of the paper strips as shown in FIG. *3c.* In this example, only one adhesive strip is used to seal the flap over the opening and onto the front panel of the envelope. When this is done the flap can be folded over the envelope opening and pressure applied to the adhesive region to produce a sealed tamper-evident envelope as appears in FIG. *3d.*

Other suitable materials can be used for the tamper-evident layer than paper, and can be applied in the same manner. For instance, cloth-like or porous materials can be used. The term "porous" is used herein in its broadest sense and includes materials having pores such as relatively small holes, openings, channels, interstices, or the like through which adhesive and fluids may pass or locate.

The tamper-evident layer(s) provide evidence of tampering with the sealed flap when such occurs even by the application of low temperatures to the seal because the forces used to try to lift the flap to give access to the contents of the envelope always distort and in some instances break apart the tamper-evident layer(s). Such distortion and breakage cannot be put back together if an attempt is made to reseal the flap. The forces act in this fashion on the tamper-evident layer of the seal regardless of which interface between layers is actually separated to open the flap after the application of low temperature to the adhesive layer. It is believed that such distortion and breaking apart always occurs in the tamper-evident layer upon an attempt to lift the flap because the adhesive as well as the heat-activatable material seeps into the interstices of the tamper-evident layer(s) which provide a mechanical-type lock onto the tamper-evident layer material. Consequently, when the forces are placed on the flap such a by fingers trying to open it after it has been sealed, the tamper-evident layer distorts and breaks apart.

The term "tamper-evident layer(s)" is also used herein in its broadest sense. For example, the layer can be one layer thick or be a lamination of multiple layers. It can be in the form of a strip that is the same size as the adhesive strip so as to form a total interface between the plastic envelope material and adhesive strip, or it can be smaller or larger than the adhesive strip. It can also take the form of a pattern such as a graphic design or indicia or a totally random pattern, any such patterns providing some areas whereat the tamper-evident layer is an interface between the flap or envelope and adhesive strip with the remaining areas of the adhesive layer contacting and adhering to the flap or envelope directly. The layer may also have indicia printed thereon which, in addition to the layer itself, also visibly distorts and separates when a tamper attempt occurs. If the tamper-evident means is made of multiple layers, various and different indicia can be placed on or in each succeeding layer to further make visible a tampering attempt.

The tamper-evident layer provides tamper evidence even when low temperatures are placed in the adhesive regions in stark contrast to the prior art systems. This is due to the presence of the tamper-evident layer which distorts and breaks apart. When low temperatures are applied to the adhesive areas in the prior art systems, that is, when the adhesive strip lies directly and only on the plastic envelope material, the adhesive strip can be readily pulled off and resealed without any visible evidence of tampering occurring on the plastic envelope or flap or adhesive strip.

Figure 4A:
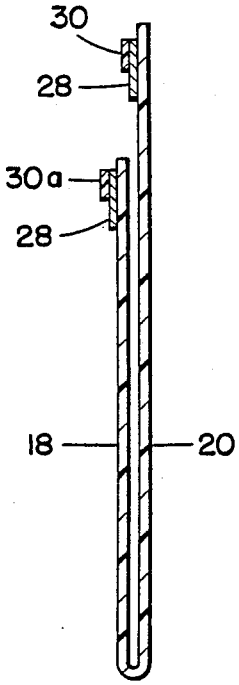
FIG. 4*a* is a schematic illustration of a cross-section of an envelope having an adhesive and tamper-evident layer on both the envelope and envelope flap.
Figure 4B:
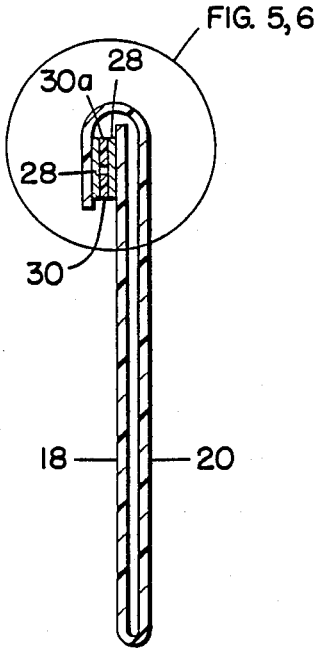
FIG. 4*b* is a schematic illustration of a cross-section of the envelope in FIG. 4*a* after sealing of the flap onto the envelope has occurred.

The tamper-evident layer can be used on virtually all adhesive seal/plastic envelope configurations with success. For instance, in FIGS. 4*a* and *b* both the flap and the front panel each have an adhesive strip with a tamper-evident layer, the tamper-evident layers being large enough to accommodate two adhesive strips side-by-side when the envelope is sealed. In FIG. 4*b* each strip upon sealing adheres directly to the unoccupied portion of the tamper-evident layer of the other seal thereby providing a double seal for the flap.

Figure 5:
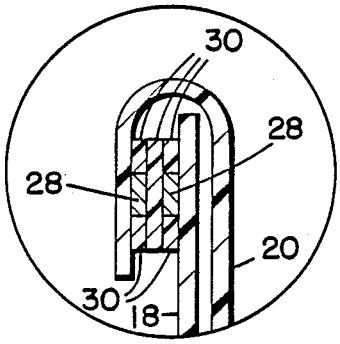
FIG. 5 is a schematic illustration of the circled area of FIG. 4*b* depicting another alternative of the adhesive layer structure.
Figure 6:
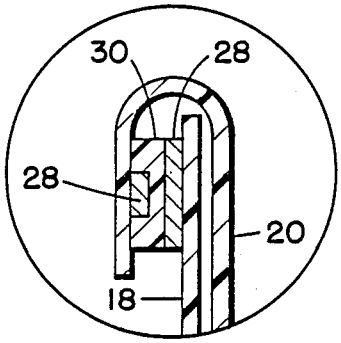
FIG. 6 is a schematic illustration of the seal in FIG. 5 depicting a further alternative.
Figure 2A:
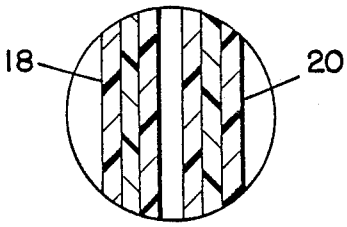

In another embodiment of the invention, both or at least one of the tamper-evident layers, preferrably the one on the flap, can be flanked on either side by a direct adhesive-to-plastic envelope interface as shown in FIG. 5. In this approach, any attempt to spray a cooling spray, such as "Component Cooler" mentioned above under the flap end to cause a low temperature on the seal enhances the visibility of the tamper evidency of the tamper-evident layer, and tends to keep the flap sealed onto the envelope in a more secure fashion. The adhesive-to-plastic envelope direct interface, may be made to flank only one side of the tamper-evident layer on the flap, or in the alternative, on the envelope. Several alternative embodiments of this feature are possible such as that shown in FIG. 6 wherein the surface area of the adhesive close to the flap end is larger that above the tamper-evident layer 28 immediately above.

It should be understood that the foregoing description is only illustrative of the invention. Various alternatives and modifications can be devised by those skilled in the art without departing from the invention. Accordingly, the present invention is intended to embrace all such alternatives and variances which fall within the scope of the appended claims.

I claim:

1. A tamper-evident seal for use with a plastic envelope comprising:

envelope pocket for holding contents therein made of an envelope material, the pocket having an opening therein through which contents can be placed into the pocket;

plastic envelope closing means which when placed over and secured to the envelope forms a closed pocket;

adhesive sealing means on at least one component, the closing means or envelope pocket, for sealing the closing means to the envelope; and tamper-evident means by which attempts to open the closing means will disrupt the continuity of the tamper-evident means so as to make it evident that tampering of the closing means has occurred, the tamper-evident means including tamper-evident layer means being located at least partially between the adhesive sealing means and the one component, the tamper-evident layer being bonded to the one component and adhering to the adhesive sealing means, and another tamper-evident layer at least partially located at the portion of the other component to which the adhesive sealing means is to be sealed, the other tamper-evident layer being bonded to the other component whereby after sealing the closing means to the envelope, the tamper-evident means visibly distorts and/or breaks apart if attempts are made to reopen the seal.

2. The seal as in claim 1 wherein the tamper-evident layer includes paper.

3. The seal as in claim 2 wherein one side of the paper has a heat-activatable layer of plastic that, when activated and placed on the components, bonds to the components.

4. The seal as in claim 3 wherein the heat-activatable layer is polyethylene.

5. The seal as in claim 1 wherein the tamper-evident layer includes a porous material.

6. The seal as in claim 1 wherein the tamper-evident layer includes fibrous material.

7. The seal as in claim 1 wherein the tamper-evident layer contains indicia.

8. The seal as in claim 1 wherein the tamper-evident layer forms a complete interface between the sealing means and the one component.

9. The seal as in claim 1 wherein the closing means is a flap means integral with the pocket.

10. The seal as in claim 1 wherein the closing means is a separate member from the pocket.

11. The seal as in claim 1 wherein the sealing means material is one which is activated by placing the closing means onto the envelope over the opening and applying pressure to the sealing means.

12. The seal as in claim 1 wherein the closing means has two portions, a main portion which is adjacent the sealing means when the main portion is placed over the opening of the pocket and sealed thereat and a detachable end portion which can be removed from the main portion of the closing means as a receipt.

13. The seal as in claim 12 wherein the main portion of the closing means has identifying indicia thereon.

14. The seal as in claim 13 wherein the end portion of the closing means has identifying indicia thereon, at least a portion thereof which is common with the indicia on its respective main portion.

15. The seal as in claim 1 wherein the envelope is constructed of a single panel of material wherein the pocket has a bottom portion opposite the opening means which is formed by a folded portion of the material, the fold forming the front and back of the pocket and side portions between the opening means and bottom portion formed by the bonding of the front and back portions of the pocket.

16. The seal as in claim 1 wherein the envelope material includes a monolayer film.

17. The seal as in claim 1 wherein the envelope material includes a multiple layer coextruded film.

18. The seal as in claim 1 wherein the envelope material includes a laminated film.

19. A tamper-evident system for a plastic member having an adhesive sealing means associated therewith comprising tamper-evident layer means located at least partially between the sealing means and plastic member, the tamper-evident layer means being bonded to the plastic member and adhering to the adhesive sealing means, whereby attempts to separate the adhesive sealing means from the plastic member cause the tamper-evident layer means to visibly distort and break apart.

20. The system as in claim 31 wherein the tamper-evident layer means includes paper.

21. The system as in claim 31 wherein the paper is bonded to the plastic material by a heat-activatable plastic material.

22. The method of forming a tamper-evident sealing means onto a plastic envelope material comprising:

bonding a tamper-evident layer means at least partially in the region of the plastic envelope where the seal is to be located;

adhering an adhesive seal material in the region of the plastic material where the seal is to be located at least partially over the tamper-evident layer means; and bonding another tamper-evident means at least partially in the region of the plastic material where the seal is to be made.

23. The method of claim 22 preceded by the step of forming the plastic envelope.

24. The method of claim 22 followed by the step of forming the plastic envelope.

25. The method of claim 22 preceded by the step of placing a heat-activatable plastic material on the side of the tamper-evident layer means adjacent the envelope material.

26. The method of claim 25 wherein the heat-activatable plastic material is heat-activated when placed on the tamper-evident layer and the tamper-evident layer is bonded to the envelope material while the heat-activatable plastic material is still heat-activated.

27. The method of claim 22 preceded by the step of placing a heat-activatable plastic material on the envelope material in the region where the tamper-evident layer is to be bonded.

28. A tamper-evident seal for use with a plastic envelope comprising:

envelope pocket for holding contents therein made of a envelope material, the pocket having an opening therein through which contents can be placed into the pocket;

plastic envelope closing means which when placed over and secured to the envelope forms a closed pocket;

pressure-activated adhesive sealing means on at least one component, the closing means or envelope pocket, for sealing the closing means to the envelope;

first tamper-evident layer means located at least partially between the adhesive sealing means and the one component, the first tamper-evident layer means being bonded to the one component and adhering to the adhesive sealing means; and second tamper-evident layer means located at least partially on a portion of the other component to which the adhesive sealing means adheres when the closing means is sealed to the envelope, the second tamper-evident layer means being bonded to the other component whereby after sealing the closing means to the envelope, at least one of the tamper-evident means visibly distorts and/or breaks apart if attempts are made to reopen the seal.

29. The seal as in claim 28 wherein the first and second tamper-evident layer means have a heat-activatable layer thereon which bonds the tamper-evident layer means to the components.

30. The seal as in claim 29 wherein the envelope, closing means and heat-activatable layer are polyethylene.

31. The method of forming a tamper-evident seal system onto a plastic material comprising:

bonding a tamper-evident means at least partially in the region of the plastic material where the seal is to be located; and adhering an adhesive seal material in the region of the plastic material where the seal is to be located at least partially over the tamper-evident layer means.

* * * * *